US007628695B2

(12) United States Patent
Lee

(10) Patent No.: US 7,628,695 B2
(45) Date of Patent: Dec. 8, 2009

(54) INTERACTIVE WAGERING SYSTEM WITH AUTOMATIC RUNNER SELECTION

(75) Inventor: Christopher A. Lee, Hollywood, CA (US)

(73) Assignee: ODS Properties, Inc., Los Angeles, CA (US)

( * ) Notice: Subject to any disclaimer, the term of this patent is extended or adjusted under 35 U.S.C. 154(b) by 0 days.

(21) Appl. No.: 12/012,316

(22) Filed: Feb. 1, 2008

(65) Prior Publication Data

US 2008/0214290 A1 Sep. 4, 2008

Related U.S. Application Data

(63) Continuation of application No. 09/727,248, filed on Nov. 29, 2000.

(51) Int. Cl.
*A63F 9/24* (2006.01)

(52) U.S. Cl. ..... 463/25

(58) Field of Classification Search ..... None
See application file for complete search history.

(56) References Cited

U.S. PATENT DOCUMENTS

| | | | |
|---|---|---|---|
| 3,909,002 | A | 9/1975 | Levy |
| 4,033,588 | A | 7/1977 | Watts |
| 4,108,361 | A | 8/1978 | Krause |
| 4,322,612 | A | 3/1982 | Lange |
| 4,339,798 | A | 7/1982 | Hedges et al. |
| 4,372,558 | A | 2/1983 | Shimamoto et al. |
| 4,494,197 | A | 1/1985 | Troy et al. |
| 4,593,904 | A | 6/1986 | Graves |
| 4,636,951 | A | 1/1987 | Harlick |
| 4,652,998 | A | 3/1987 | Koza et al. |
| 4,689,742 | A | 8/1987 | Troy et al. |
| 4,694,490 | A | 9/1987 | Harvey et al. |
| 4,704,725 | A | 11/1987 | Harvey |
| 4,706,121 | A | 11/1987 | Young |
| 4,745,468 | A | 5/1988 | Von Kohorn |
| 4,747,600 | A | 5/1988 | Richardson |
| 4,760,527 | A | 7/1988 | Sidley |
| 4,764,666 | A | 8/1988 | Bergeron |

(Continued)

FOREIGN PATENT DOCUMENTS

| | | |
|---|---|---|
| EP | 0 387 046 A2 | 9/1990 |

(Continued)

OTHER PUBLICATIONS

"An easy way to Fortune" Evening Post, Ray O'Conner, May 29, 1997.

(Continued)

*Primary Examiner*—Ronald Laneau
*Assistant Examiner*—Tramar Harper
(74) *Attorney, Agent, or Firm*—Brian E. Mack; Ropes & Gray LLP

(57) ABSTRACT

An interactive wagering application is provided that automatically picks horses for a user to use when creating a wager for a race to be run. The interactive wagering application may select the numbers using a random number generation application implemented on computer equipment at a transaction processing and subscription management system 24. The user may direct the interactive wagering application to automatically select the horses for the race by selecting an on-screen option or the like.

21 Claims, 8 Drawing Sheets

U.S. PATENT DOCUMENTS 4,799,683 A 1/1989 Bruner, Jr.
4,815,741 A 3/1989 Small
4,882,473 A 11/1989 Bergeron et al.
4,922,522 A 5/1990 Scanlon
4,926,255 A 5/1990 Von Kohorn
4,926,327 A 5/1990 Sidley
4,965,825 A 10/1990 Harvey et al.
4,969,183 A 11/1990 Reese
4,996,705 A 2/1991 Entenmann et al.
5,007,649 A 4/1991 Richardson
5,034,807 A 7/1991 Von Kohorn
5,054,787 A 10/1991 Richardson
5,057,915 A 10/1991 Von Kohorn
5,083,271 A 1/1992 Thacher et al.
5,083,272 A 1/1992 Walker et al.
5,083,800 A 1/1992 Lockton
5,096,195 A 3/1992 Gimmon
5,096,202 A 3/1992 Hesland
5,112,050 A 5/1992 Koza et al.
5,119,295 A 6/1992 Kapur
5,178,389 A 1/1993 Bentley et al.
5,186,471 A 2/1993 Vancraeynest
5,218,631 A 6/1993 Katz
5,227,874 A 7/1993 Von Kohorn
5,233,654 A 8/1993 Harvey et al.
5,249,044 A 9/1993 Von Kohorn
5,276,312 A 1/1994 McCarthy
5,280,426 A 1/1994 Edmonds
5,282,620 A 2/1994 Keesee
5,283,734 A 2/1994 Von Kohorn
5,286,023 A 2/1994 Wood
5,297,802 A 3/1994 Pocock et al.
5,326,104 A 7/1994 Pease et al.
5,327,485 A 7/1994 Leaden
5,333,868 A 8/1994 Goldfarb
5,340,119 A 8/1994 Goldfarb
5,351,970 A 10/1994 Fioretti
5,354,069 A 10/1994 Guttman et al.
5,365,575 A 11/1994 Katz
5,398,932 A 3/1995 Eberhardt et al.
5,403,999 A 4/1995 Entenmann et al.
5,408,417 A 4/1995 Wilder
5,415,416 A 5/1995 Scagnelli et al.
5,417,424 A 5/1995 Snowden et al.
5,505,449 A 4/1996 Eberhardt et al.
5,507,489 A 4/1996 Reibel et al.
5,518,253 A 5/1996 Pocock et al.
5,539,450 A 7/1996 Handelman
5,539,822 A 7/1996 Lett
5,545,088 A 8/1996 Kravitz et al.
5,564,977 A 10/1996 Algie
5,569,083 A 10/1996 Fioretti
5,573,244 A 11/1996 Mindes
5,575,474 A 11/1996 Rossides
5,577,727 A 11/1996 Brame et al.
5,586,937 A 12/1996 Menashe
5,608,785 A 3/1997 Kasdav
5,643,088 A 7/1997 Vaughn et al.
5,647,795 A 7/1997 Stanton
5,679,077 A 10/1997 Pocock et al.
5,683,090 A 11/1997 Zeile et al.
5,688,174 A 11/1997 Kennedy
5,713,795 A 2/1998 Kohorn
5,722,890 A 3/1998 Libby et al.
5,729,212 A 3/1998 Martin
5,746,657 A 5/1998 Ueno
5,749,785 A 5/1998 Rossides
5,755,621 A 5/1998 Marks et al.
5,759,101 A 6/1998 Von Kohorn
5,762,552 A 6/1998 Vuong et al.
5,772,511 A 6/1998 Smeltzer
5,787,156 A 7/1998 Kate
5,800,268 A 9/1998 Molnick
5,816,917 A 10/1998 Kelmer et al.
5,816,919 A 10/1998 Scagnelli et al.
5,823,879 A 10/1998 Goldberg et al.
5,830,067 A 11/1998 Graves et al.
5,830,068 A * 11/1998 Brenner et al. ..... 463/42
5,830,069 A 11/1998 Soltesz et al.
5,871,398 A 2/1999 Schneier et al.
5,910,047 A 6/1999 Scagnelli et al.
5,954,582 A 9/1999 Zach
5,957,775 A 9/1999 Cherry
5,999,808 A 12/1999 LaDue
6,001,016 A 12/1999 Walker et al.
6,007,426 A 12/1999 Kelly et al.
6,024,640 A 2/2000 Walker et al.
6,024,641 A 2/2000 Sarno
6,030,288 A 2/2000 Davis et al.
6,080,062 A 6/2000 Olson
6,080,063 A 6/2000 Khosla
6,099,408 A 8/2000 Schneier et al.
6,102,797 A 8/2000 Kail
6,117,011 A 9/2000 Lvov
6,117,013 A 9/2000 Eiba
6,152,824 A 11/2000 Rothschild et al.
6,186,892 B1 2/2001 Frank et al.
6,203,427 B1 3/2001 Walker et al.
6,251,016 B1 6/2001 Tsuda et al.
6,251,017 B1 6/2001 Leason et al.
6,254,480 B1 7/2001 Zach
6,257,982 B1 7/2001 Rider et al.
6,263,054 B1 7/2001 Haefliger
6,264,560 B1 7/2001 Goldberg et al.
6,272,223 B1 8/2001 Carlson
6,273,820 B1 8/2001 Haste, III
6,287,199 B1 9/2001 McKeown et al.
6,325,721 B1 12/2001 Miyamoto et al.
6,358,150 B1 * 3/2002 Mir et al. ..... 463/28
6,406,371 B1 6/2002 Baba et al.
6,508,709 B1 1/2003 Karmarkar
6,508,710 B1 1/2003 Paravia et al.
6,666,769 B2 12/2003 Stronach
6,676,514 B1 1/2004 Kusuda et al.
6,688,976 B1 2/2004 Tulley et al.
6,695,701 B2 2/2004 Aronson et al.
6,722,980 B2 4/2004 Stronach
2001/0003099 A1 6/2001 Von Kohorn
2001/0003100 A1 6/2001 Yacenda

FOREIGN PATENT DOCUMENTS

EP 0 583 196 B1 2/1994
EP 0 620 688 A2 10/1994
EP 0 624 039 A2 11/1994
EP 0 673 004 A2 9/1995
EP 0 873 722 A1 10/1998
EP 0 934 765 A1 8/1999
GB 2 300 535 11/1996
JP 01-25659 1/1989
JP 01-269157 10/1989
JP 02-110660 4/1990
JP 02-231671 9/1990
JP 06-325062 11/1994
WO WO 95/01058 1/1995
WO WO 95/30944 11/1995
WO WO 97/19428 5/1997
WO WO 00/67215 A1 11/2000
WO WO 0067215 A1 * 11/2000

OTHER PUBLICATIONS

"Punters Dine Out on Easybet", The Press, Apr. 20, 1999.
"Easybet punter keeps cool after huge win", Barry Lichter, Sunday Star Times, Aug. 27, 2000.

http://www.tab.co.nz which was archived by the Internet Archive Wayback Machine on Jun. 23, 1998 and can be assessed from the following URL: http://web.archive.org/web/19980623064154/http://www.tab.co.nz/.

You Bet Help File, Youbet.com, Inc., Los Angeles, California, last modified Jul. 11, 1998, pp. 1-132.

Maury Wolff, "Interactive Wagering A Good Bet," Daily Racing Form, Jan. 29, 1995, p. 4.

John Burgess, "And Were Off To The Races!" The Washington Post, Jan. 16, 1995, pp. 17-18.

Ross Peddicord, "New on TV: You Bet Your Horse," The Sun, Baltimore, Maryland, Dec. 15, 1994.

Yee-Hsiang Chang et al., "An Open-Systems Approach To Video On Demand," IEEE Communications Magazine, May 1994, pp. 68-80.

TrackMaster User's Guide Version 2.0.7, Apr., 1994, AXCIS Pocket Information Network, Inc., Santa Clara, California, pp. 1-122.

Tiny Time Brochure, AutoTote Systems Inc., Newark, Delaware (undated).

Probe XL Brochure, AutoTote Systems, Inc., Newark, Delaware (undated).

US 5,823,877, 10/1998, Scagnelli et al. (withdrawn)

* cited by examiner

INTERACTIVE WAGERING SYSTEM WITH AUTOMATIC RUNNER SELECTION

CROSS-REFERENCE TO RELATED APPLICATION

This is a continuation of U.S. patent application Ser. No. 09/727,248, filed Nov. 29, 2000, which is hereby incorporated by reference herein in its entirety.

BACKGROUND OF THE INVENTION

This invention relates to interactive wagering, and more particularly, to interactive wagering applications that allow runners for wagers on races to be automatically selected.

Wagering is a popular leisure activity. For example, many racing fans wager on events such as horse, dog, and harness racing. However, it may be inconvenient to attend racing events in person. Not all racing fans have sufficient time to visit racetracks as often as they would like and some fans have difficulties in obtaining suitable transportation to the track. Off-track betting establishments are available for fans who cannot attend racing events in person, but fans must still travel to the off-track betting establishments.

As a result, systems have been developed in which fans may place off-track wagers using personal computers connected to the Internet, standard telephones, or set-top boxes.

It is an object of the present invention to improve such systems by providing an interactive wagering system that automatically generates runner numbers for users to use in placing wagers.

SUMMARY OF THE INVENTION

An interactive wagering system is provided in which an interactive wagering application automatically randomly selects a horse or horses for a wager on a race to be run. The user may select a racetrack for the wager, a desired race at that racetrack, a desired wager type (win, place, show, exacta, etc.), and a desired wager amount. The user may also select an on-screen option that directs the interactive wagering application to automatically randomly select which horse or horses to use for the wager. If the user is satisfied with the horse or horses that the interactive wagering application has randomly selected for the wager, the user may submit the wager for processing by a transaction processing and subscription management system.

If desired, the on-screen option that is used to invoke the automatic horse selection feature may be presented for the user on a horse selection screen. The user may also be provided with an opportunity to select horses manually. A graphic image that is related to the horses that are automatically selected may be displayed on the horse selection screen.

The interactive wagering application may be implemented using various platforms including set-top box arrangements and other user television equipment, personal computers, notebook computers, handheld computers and other user computer equipment, cellular telephones with displays, telephones without displays, and other user telephone equipment, etc.

The interactive wagering application may be used to place wagers on various different types of races, including dog races, horse races, harness races, etc.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
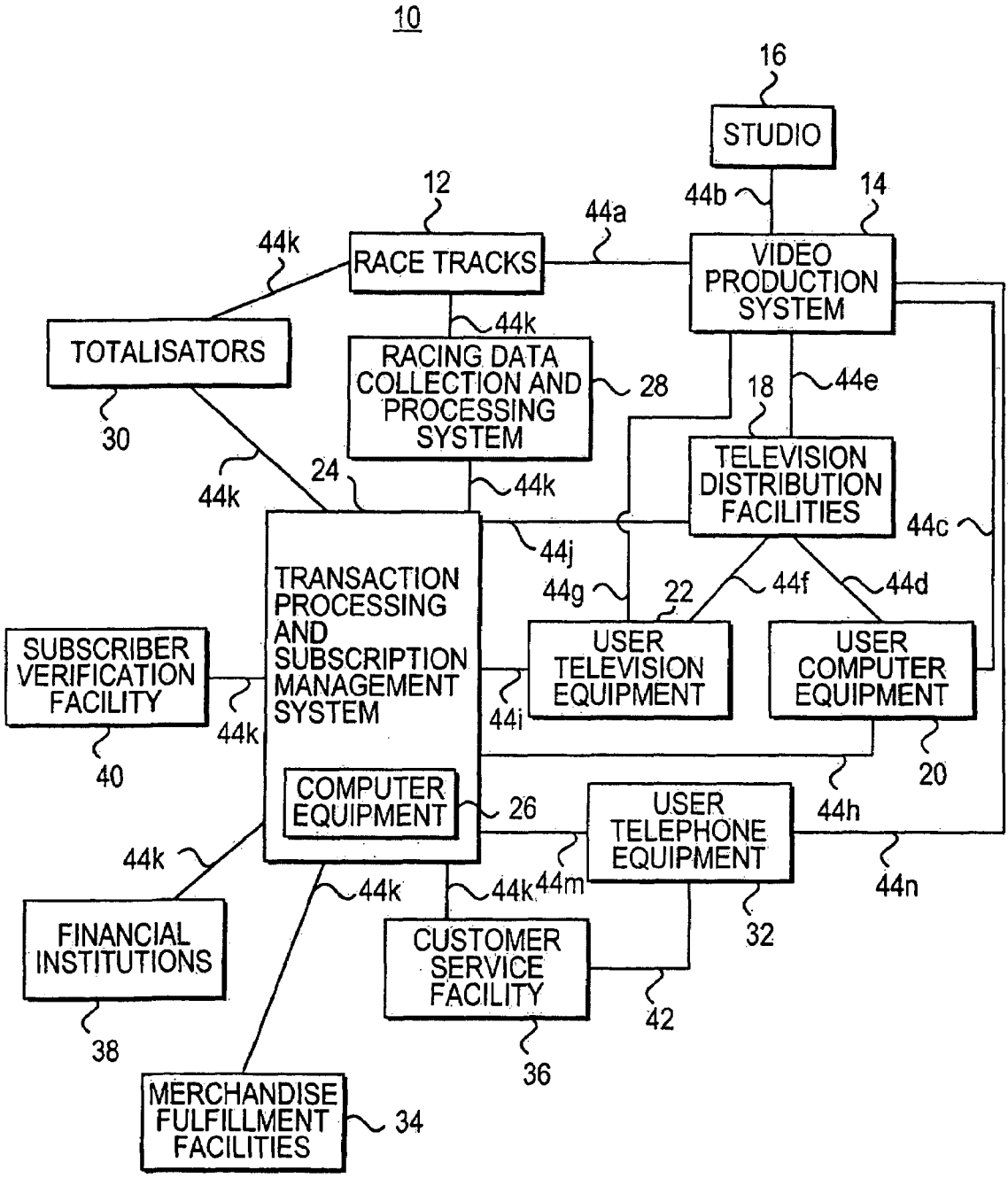
FIG. 1 is a schematic diagram of an illustrative interactive wagering system on which an interactive wagering application may be implemented in accordance with the present invention.

An illustrative interactive wagering system 10 in accordance with the present invention is shown in FIG. 1. Aspects of the invention apply to various different types of wagering, but are described herein primarily in the context of interactive wagering on races (e.g., horse races) for specificity and clarity.

Races may be run at racetracks 12, which may be located at various geographic locations. Races run at the racetracks may be simulcast to television viewers. For example, simulcast videos may be provided to users with satellite receivers or to off-track betting establishments via satellite.

System 10 may be used to provide an interactive wagering service to users of various user equipment. An interactive wagering application may be used to provide the wagering service. The interactive wagering application may run locally on the user equipment (e.g., on a set-top box, personal computer, cellular telephone, handheld computing device, etc.) or may run using a client-server or distributed architecture where some of the application is implemented locally on the user equipment in the form of a client process and some of the application is implemented at a remote location (e.g., on a server computer or other such equipment in the system) as a server process. These arrangements are merely illustrative. Other suitable techniques for implementing the interactive wagering application may be used if desired.

Real-time videos from racetracks 12 may also be provided to video production system 14 for distribution to users as part of a television wagering service (i.e., a wagering-related television channel or Internet-delivered service or the like). If desired, multiple simulcast videos may be provided to video production system 14 in real-time. Talent (e.g., commentators) for the television wagering service provided by the interactive wagering application may be located at studio 16. Studio 16 may provide a video feed containing commentary and the like to video production system 14. Graphic overlays for the television wagering service may be added to the service at video production system 14.

The television wagering service may use video production system 14 to combine selected video segments from desired racing simulcasts with the video feed from studio 16 and suitable graphic overlays. If desired, video production system 14 or a separate facility may be used to reformat simulcasts from racetracks 12. For example, if racetracks 12 provide simulcasts as traditional analog television channels, video production system 14 (or a separate facility) may convert these simulcasts or portions of these simulcasts into digital signals (e.g., digital video signals) or into a different number of analog signals. Digital video signals may require less bandwidth than analog video signals and may be appropriate for situations in which videos are to be transmitted over either high or low bandwidth pathways. Low bandwidth pathways may include telephone lines, the Internet, etc.

Video production system 14 may be used to provide a television wagering service that includes selected simulcast videos, video from studio 16, and graphic overlays to television distribution facilities 18 (for redistribution to user television equipment 22 and user computer equipment 20), to user computer equipment 20, and to user telephone equipment 32 (if user telephone equipment 32 has a display capable of displaying moving images). Television distribution facilities 18 may be any suitable facilities for supplying television to users, such as cable system headends, satellite systems, broadcast television systems, or other suitable systems or combinations of such systems. User computer equipment 20 may be any suitable computer equipment that supports an interactive wagering application. For example, user computer equipment 20 may be a personal computer. User computer equipment 20 may also be based on a mainframe computer, a workstation, a networked computer or computers, a laptop computer, a notebook computer, a handheld computing device such as a personal digital assistant or other small portable computer, etc.

Each of television distribution facilities 18 is typically located at a different geographic location. Users with user television equipment 22 may receive the television wagering service from an associated television distribution facility. User television equipment 22 may include, for example, a television or other suitable monitor. A television may be used to watch the television wagering service on a traditional analog television channel. User television equipment 22 may also include a digital or analog set-top box connected to a television distribution facility 18 by a cable path. A digital set-top box may be used to receive the television wagering service on a digital channel. If desired, user television equipment 22 may contain a satellite receiver, a WebTV box, a personal computer television (PC/TV), or hardware similar to such devices into which set-top box capabilities have been integrated. A recording device such as a videocassette recorder or digital recording device (e.g., a personal, video recorder or digital video recorder based on hard disk drives or the like) may be used in user television equipment 22 to store videos. The recording device may be separate from or part of the other components of user television equipment 22.

User computer equipment 20 may receive the television wagering service using a video card or other video-capable equipment to receive analog or digital (e.g., moving picture experts group or MPEG) videos from a television distribution facility. User computer equipment 20 may also receive the television wagering service directly from video production system 14 using, for example, a modem link. If desired the video for the television wagering service may be compressed (e.g., using MPEG techniques). This may be useful, for example, if the path to user computer equipment 20 is a modem connection using telephone links. If video production system 14 is only used to serve user computer equipment 20 without traditional analog television capabilities, video production system 14 may only need to supply such digitally-compressed video signals and not analog television signals.

Video clips of races and other simulcast information may be provided to users in the form of a television wagering service or by an interactive wagering service provided by the interactive wagering application. If desired, race-related videos may be provided to the user by using video production system 14 or other suitable equipment to route appropriate video clips from the simulcasts to the user in real-time. Video clips may also be stored for later viewing. For example, one or more video servers located at racetracks 12, video production system 14, television distribution facilities 18, or other suitable locations may be used to store video clips. The stored videos may then be played back in real-time or downloaded for viewing at user television equipment 22, user computer equipment 20, or user telephone equipment 32. The video clips may contain videos of races, commentary, interviews with jockeys, or any other suitable race-related information. If desired, real-time or stored videos may be provided from racetracks 12 directly to user television equipment 22, user computer equipment 20, or user telephone equipment 32 over the Internet or other suitable communications paths without involving video production system 14. Videos may also be provided by routing video signals through equipment located elsewhere in system 10. For example, videos may be routed through transaction processing and subscription management system 24.

Transaction processing and subscription management system 24 may contain computer equipment 26 and other equipment for supporting system functions such as transaction processing (e.g., handling tasks related to wagers, product purchasing, adjusting the amount of funds in user accounts based on the outcomes of wagers, video clip ordering, etc.), data-distribution (e.g., for distributing racing data to the users), and subscriber management (e.g., features related to opening an account for a user, closing an account, allowing a user to add or withdraw funds from an account, changing the user's address or personal identification number, etc.). Databases within transaction processing and subscription management system 24 or associated with system 24 may be used to store racing data, wagering data and other transaction data, and subscriber data such as such as information on the user's current account balance, past wagering history, individual wager limits, personal identification number, billing addresses, credit card numbers, bank account numbers, social security numbers, etc. Using such databases may allow the user to access information more quickly and allows for central administration of the wagering service.

If desired, racing videos and other services may be provided using servers and other equipment located at transaction processing and subscription management system 24. For example, video clips may be provided to the user on-demand. Interactive advertisements may be provided to the user. When the user selects a desired advertisement, transaction processing and subscription management system 24 may provide additional information or other services related to the advertisement to the user.

Product ordering services may be implemented using computer equipment at transaction processing and subscriber management system 24 to handle orders and to assist in adjusting the appropriate account of the user accordingly. Orders may be fulfilled using merchandise fulfillment facilities 34. Merchandise fulfillment facilities 34 may be operated solely to provide merchandise fulfillment or may be associated with independently-operated mail-order or on-line businesses. Similar facilities may be used to allow users to order services.

Statistical racing data such as the post times for each race, jockey names, runner names and the number of races associated with each track, handicapping information (e.g., information on past performances such as the number of wins and losses for the past year, etc.), and weather conditions at various tracks may be provided by racing data collection and processing system 28. Some of the data may be collected from racetracks 12 and some may be provided by third party information sources such as Axcis Pocket Information Network, Inc. of Santa Clara, Calif. or other suitable data sources.

Racing data may also be provided from totalisators 30. Totalisators 30 are the computer systems that may be used to handle wagers made at the racetracks, made at off-track betting establishments, and made using interactive wagering system 10. Totalisators 30 generate wagering odds in real-time. Totalisators 30 generate these odds based on information on which wagers are being placed (e.g., based on information on which wagers are being placed on races at racetracks 12). Totalisators 30 are available from companies such as Amtote International, Inc. of Hunt Valley, Md. Totalisators 30 may be associated with individual racetracks 12 or groups of racetracks 12. Totalisators 30 may communicate with one another using a communication protocol known as the Intertote Track System Protocol (ITSP). This allows totalisators 30 to share wagering pools. Totalisators 30 may provide racing data including information on the current races at racetracks 12, the number of races associated with each racetrack, win, place, and show odds and pool totals for each horse or other runner, and exacta, trifecta, and quinella payoff predictions and pool totals for every possible combination of runners. Totalisators 30 may also provide current odds and other real-time racing data for other types of wagers. Totalisators 30 may provide the time until post time for each race.

Totalisators 30 may provide race results, such as the order-of-finish list for at least the first three positions and payoff values versus a standard wager amount for win, place, and show, for each runner in the finish list. Payoff values may be provided for winning complex wager types such as exacta, trifecta, quinella, pick-n (where n is the number of races involved in the pick-n wager), and daily double. The payoff values may be accompanied by a synopsis of the associated finish list.

Totalisators 30 may also provide program information of the type typically provided in printed racing programs. Such program information may include early odds, early scratches, race descriptions (including the distance of each race and the race surface—grass, dirt, artificial turf, etc.), allowed class ratings (based on a fixed ratio of external criteria), purse value (payoff to winning runner), allowed age range of runners, and the allowed number of wins and starts for each runner.

If desired, some of the information provided to transaction processing and subscription management system 24 by totalisators 30 (such as the program information or other suitable racing data) may be provided by racing data collection and processing system 28. Similarly, some of the information provided to transaction processing and subscription management system 24 by racing data collection and processing system 28 may be provided by totalisators 30. Moreover, the foregoing examples of different suitable types of racing data are merely illustrative. Any suitable data related to racing may be provided to transaction processing and subscription management system if desired.

Transaction processing and subscription management system 24 provides the racing data to users at user television equipment 22, user computer equipment 20, and user telephone equipment 32 for use in following race results and developing wagers. If desired, racing data may be provided to users using paths that do not directly involve transaction processing and subscription management system 24. For example, racing data may be provided from racing data collection and processing system 28 to user television equipment 22, user computer equipment 20, or user telephone equipment 32 using the Internet or other suitable communications paths.

User telephone equipment 32 may be a conventional telephone, a cordless telephone, a cellular telephone or other portable wireless telephone, or any other suitable telephone equipment. Users at user television equipment 22 and user computer equipment 20 may view information on the racing data on a television or other suitable monitor. Users at user telephone equipment 32 may listen to racing data using an interactive voice system. User telephone equipment 32 may be based on cellular telephones with displays. Users may view racing data displayed on such displays.

Users who wish to place wagers may establish an account at transaction processing and subscription management system 24. An account may also be established at one of totalisators 30. The user and the interactive wagering services may have their own bank accounts at financial institutions 38. A user may set up an account electronically by using user television equipment 22, user computer equipment 20, or user telephone equipment 32 to interact with the subscriber management functions of transaction processing and subscription management system 24. If desired, accounts may be established with the interactive wagering service with the assistance of customer service representatives at customer service facility 36. Customer service facility 36 may be at the same location as transaction processing and subscription management system 24, may be part of system 24, or may be located remote from system 24. Customer service representatives at customer service facility 36 may be reached by telephone. If user telephone equipment 32 is used to access the interactive wagering service, for example, user telephone equipment 32 may be used to reach the customer service representative using communications path 42. If user television equipment 22 or user computer equipment 20 is being used with the service, a telephone at the same location as that equipment may be used to reach the customer service representative.

The user's identity may be checked using social security number information or other identification information with the assistance of subscriber verification facility 40. The services of subscriber verification facility 40 are used to ensure that the user lives in a geographic area in which wagering is legal, that the user is of a legal age, and that the identification information (e.g., the user's social security number) matches the name provided by the user. If the user is using a cellular telephone or handheld computing device, the user's present physical location may be determined by determining which general part of the cellular telephone network is being accessed by the user or by using the cellular network or a handset-based location device such as a global positioning system (GPS) receiver in the body of the cellular telephone to pinpoint the user's location. This location information may be used to verify that the user is located in a geographic area where wagering is legal.

In a typical enrollment process, the user provides personal information to the interactive wagering service and provides funds with a credit card or funds from the user's bank account. The interactive wagering service sets up an account for the user at transaction processing and subscription management system 24 and directs one of totalisators 30 to set up a new account for the user at the totalisator. The totalisator is also directed to credit the user's account to reflect the amount of funds provided by the user. After the user places a wager and wins or loses, the totalisator adjusts the user's totalisator account to reflect the outcome of the wager. The totalisator may periodically inform the interactive wagering service of the adjusted balance in the user's account. This may be accomplished using any suitable technique (e.g., periodically, continuously, on-request, etc.). For example, reports may be collected periodically (e.g., once a day in an end-of-day report) and provided to the interactive wagering service to reconcile the account balances at transaction processing and subscription management system 24 with the account balances at totalisators 30.

If the user makes a balance inquiry, the inquiry may be passed to the appropriate totalisator by transaction processing and subscription management system 24. If the user is charged a fee for subscribing to the service, the service may debit the fee from the user's account at the transaction processing and subscription management system 24.

The accounts at totalisators 30 and transaction processing and subscription management system 24 are typically maintained separately, because the business entities that operate totalisators 30 and transaction processing and subscription management system 24 are independent. If desired, financial functions related to opening and maintaining user accounts and the like may be handled using computer equipment at another location such as one of financial institutions 38 or other location remote from totalisators 30 and system 24. Such financial functions may also be implemented primarily at a totalisator 30 or primarily at the transaction processing and subscription management system 24 if desired.

Users at user television equipment 22, user computer equipment 20, and user telephone equipment 32 may place wagers by providing wagering data and otherwise interacting with transaction processing and subscription management system 24. The interactive wagering service may provide a user at user television equipment 22, user computer equipment 20, or user telephone equipment 32 that has display capabilities with screens containing various racing data. For example, the user may be presented with screens that allow the user to view the current odds for horses in an upcoming race at a given track.

The service may provide the user with interactive screens containing menus and selectable options that allow the user to specify the type of wager in which the user is interested and the desired wager amount. With a set-top box arrangement, for example, the user may use a remote control or wireless keyboard to navigate the various menus and selectable options. With a personal computer, the user may use a keyboard, mouse, trackball, touch pad, or other suitable input or pointing device. With a cellular telephone with a display, the user may use buttons on the telephone. When the user has made appropriate selections to define a desired wager, the user television equipment, user computer equipment, or user telephone equipment may transmit wagering data for the wager to transaction processing and subscription management system 24.

Users with telephones may also interact with the service using an interactive voice response system located at transaction processing and subscription management system 24. The interactive voice response system may present menu options to the user in the form of audio prompts (e.g., "press 1 to select a $2 wager amount," etc.). The user may interact with the service be pressing the corresponding buttons on a touch tone telephone. User telephone equipment 32 that is based on cellular telephones allows the user to interact with the wagering service in this way. User telephone equipment 32 that is based on cellular telephones with messaging and display capabilities also allows the user to interact visually with the interactive wagering service.

The components of system 10 may be interconnected using various communications paths 44. Communications paths 44 may include satellite paths, coaxial cable paths, fiber-optic paths, twisted pair paths, other wire or cable-based links, wireless paths through free space, or any other suitable paths or combination of such paths. Communications over paths 44 may involve analog transmissions, digital transmissions, wireless transmissions, microwave transmissions, radio-frequency transmissions, optical transmissions, audio transmissions, or any other suitable type of transmissions or combination of such transmissions. Communications may involve Internet transmissions, private network transmissions, packet-based transmissions, television channel transmissions, transmissions in the vertical blanking interval of a television channel or on a television sideband, MPEG transmissions, etc. Communications may involve wireless pager or other messaging transmissions. Communications paths 44 may include cable connected to cable modems, digital subscriber lines, integrated services digital network (ISDN) lines, or any other suitable paths. Examples of suitable communications paths are described below. Those examples are, however, merely illustrative. Any of the communications path arrangements described above or other suitable arrangements may be used if desired.

Communications paths that carry video and particularly uncompressed analog video or lightly-compressed or full-screen digital video generally use more bandwidth than communications paths that carry only data or that carry partial-screen digital video. For example, if it is desired to transmit high-quality simulcasts of races from racetracks 12 to video production system 14, analog or digital videos may be transmitted from racetracks 12 to video production system 14 over path 44*a* using satellite links. Video may be transmitted from studio 16 to video production system 14 over path 44*b* using a satellite link or a high-speed terrestrial path such as a fiber-optic path. Studio 16 may also be located at the same site as video production system 14, thereby avoiding the need for a long-haul transmission path. Videos may be transmitted from video production system 14 to user computer equipment 20 over path 44*c* using a modem link (using, for example, a digital subscriber line, a telephone network link, a wireless link etc.) The modem link may be made over a private network.

A user with a cable modem may connect a personal computer or other such user computer equipment 20 to an associated cable system headend using path 44*d*. (The headend in such an arrangement would be one of the television distribution facilities 18 shown in FIG. 1.) The user may then receive videos from the headend via cable modem. Videos may be provided to the headend over path 44*e* using a network link, fiber optic links, cable links, microwave links, satellite links, etc. A user with a set-top box or similar device (shown in FIG. 1 as user television equipment 22) may also receive videos from a cable system headend using a cable modem or other such communications device over path 44*f*. In addition, a user with user television equipment may receive videos over the Internet or a private network using a telephone-based modem or other such communications device using path 44*g*. In a system with distributed processing, interactive wagering services may be provided using a television distribution facility 18 that includes equipment that supplements or replaces at least some of the equipment at transaction processing and subscription management system 24.

If desired, user television equipment 22 or user computer equipment 20 may receive analog or digital videos from an associated television distribution facility over the communications paths normally used to distribute television programming (e.g., paths 44*f* and 44*d*). For example, videos may be received as part of a dedicated interactive wagering service television channel. If videos are provided as digital signals (e.g., MPEG signals), 10 or more digital videos may be carried on a single analog channel (or one digital video may be carried on one-tenth of the bandwidth of an analog channel). If the videos are not full-screen videos, even more videos may be simultaneously provided without a loss of image quality.

Racing videos may be provided to user telephone equipment 32 over a partially-wireless telephone Internet link or other telephone link using path 44*n*.

If desired, racing data may accompany the racing videos along any of these paths. Moreover, racing videos may be provided by routing them directly from racetracks 12 to user television equipment 22, user computer equipment 20 (e.g., over the Internet or a private network, etc.), or user telephone equipment 32. Racing videos may also be provided by routing them through transaction processing and subscription management system 24. If a cellular telephone or portable computing device has sufficient display capabilities to support moving images, racing videos may be displayed. Such videos may be provided using any suitable path, such as a direct path from racetracks 12, a path through video production system 14 or other suitable video processing equipment, through a hub such as transaction processing and subscription management system 24, etc. Racing videos may be provided in real-time or may be recorded for later distribution. Videos that are not provided in real-time may be downloaded by user television equipment 22, user computer equipment 20, a cellular telephone, or other suitable user equipment at a lower data rate than would otherwise be required and may be downloaded in the background if desired. Such videos may also be provided to the user at real-time video rates for direct viewing by the user.

Racing data and other information related to the interactive wagering service may be provided to users over paths connected to transaction processing and subscription management system 24. For example, racing data and other data for the service may be provided to user computer equipment 20 over path 44*h* using a modem link. Path 44*h* may be a private network path or an Internet path. Path 44*h* may use telephone lines, digital subscriber lines, ISDN lines, wireless data paths, or any other suitable type of communications links. User television equipment 22 may receive-data for the wagering service over communications path 44*i*, which may be a telephone line, digital subscriber line, ISDN line, or other suitable type of communications path and which may use a private network path or an Internet path, etc.

Data for the wagering service may be provided to users of the interactive wagering application via communications path 44*j* and paths 44*f* and 44*d*. Communications path 44*j* may be provided over a private network, using the public telephone network, using satellite links, or any other suitable type of links. Data from paths such as path 44*j* may be routed to paths such as paths 44*f* and 44*d* directly by associated television distribution facilities 18, or may be buffered at television distribution facilities 18 if desired. Paths 44*f* and 44*d* may include coaxial cable and use of paths 44*f* and 44*d* may involve the use of cable modems or the like. If data is provided over path 44*j* and path 44*f* or path 44*d* using an Internet protocol, a web browser or similar software running on user television equipment 22 or user computer equipment 20 may be used to access the data. Such software may be integrated into the interactive wagering application or may be used separately. Software may also be used to view videos and may be used on other platforms (e.g., advanced cellular telephones) if desired.

The communications paths 44*k* that are used to connect various other components of the system typically do not carry high-bandwidth video signals. Accordingly, paths 44*k* may be telephone-like paths that are part of the Internet or a private network. Such paths and various other paths 44 may be dedicated connections for security, reliability, and economy.

User telephone equipment 32 may receive information for the wagering service via path 44*m*. If user telephone equipment 32 is a standard (non-cellular) telephone, such information may be in the form of audio prompts (e.g., "press 1 to place a wager") and audio racing data ("the current win odds for horse 2 are 5-1"). Transaction data processing and subscription management system 24 may contain interactive voice response equipment that provides such information to the user and that responds to touch-tone signals from the user when the user responds to prompts by pressing buttons on the user's telephone.

If user telephone equipment 32 is a cellular telephone, racing data and other information for the interactive wagering service may be provided to the user by using a cellular wireless connection as part of path 44*m*. Users with cellular telephones may be provided with audio prompts using an interactive voice response system located at transaction processing and subscription management system 24 to which the users may respond by pressing cellular telephone buttons to generate touch-tone signals.

Racing data and other information for the interactive wagering service may be provided to cellular telephones in the form of alphanumeric messages. Such messages may be transmitted to the user by using paging or other alphanumeric messaging formats or any other suitable data communications scheme. If desired, data may be provided to the cellular telephones over the voice channel and decoded by the cellular telephone using modem circuitry or other suitable circuitry. Data may also be provided using any other suitable cellular or wireless path. Regardless of the way in which racing data and other information for the interactive wagering service are provided to the cellular telephone, such information may be provided to the user by displaying it on the cellular telephone display screen or by presenting it in audible form through the speaker of the cellular telephone.

Racing data and other interactive wagering service information for the users may be provided in one or more continuous data streams, may be provided periodically (e.g., once per hour or once per day), or may be provided using a client-server arrangement in which data is requested by a client processor (e.g., user television equipment 22, user computer equipment 20, user telephone equipment 32, or any other such equipment) from a server (e.g., a server implemented using computer equipment 26 at transaction-processing and subscription management system 24 or computer equipment at another suitable location. Videos may also be provided using any of these techniques.

A return communications path between the user and the interactive wagering service may be used to allow the user to place wagers and otherwise interact with the interactive wagering service. For example, a user with a standard telephone or a cellular telephone may interact with the service by pressing touch-tone keys on the telephone in response to audio prompts provided by an interactive voice response system at transaction processing and subscription management system 24. If desired, users may call customer service representatives at customer service facility 36 and place wagers with manual assistance. The user of a cellular telephone may interact with the wagering service by selecting menu options and otherwise interacting with information displayed on the cellular telephone. When a selection is made, software implemented on the telephone may be used to assist the user in transmitting appropriate data (e.g., wagering data) to the wagering service. Such data may be transmitted using any suitable technique. For example, data may be transmitted using a wireless data link that is separate from the cellular voice channels. Data may also be transmitted over the voice channel (e.g., using a modem built into the cellular telephone, by automatically generating touch-tone signals that may be recognized by the interactive voice response system at transaction processing and subscription management system 24, or using any other suitable arrangement). These approaches may be used even if the user receives racing data and other information for the service using a platform other than a telephone-based platform.

Users with user television equipment 22 may interact with the service by sending data (e.g., wager data) to transaction processing and subscription management system 24 using path 44*i* or using paths 44*f* and 44*j*. Users with user computer equipment 20 may send data (e.g., wager data) to transaction processing and subscription management system 24 via path 44*h* or paths 44*d* and 44*j*. Users at any user equipment may send data for the service to locations other than transaction processing and subscription management system 24. For example, the user may provide information directly to customer service facility 36, etc.

If desired, the user may send data to the service at transaction processing and subscription management system 24 using different paths than those used to receive data from transaction processing and subscription management system 24. For example, racing data may be received at user television equipment 22 via paths 44*j* and 44*f*, whereas data may be sent by the user from user television equipment 22 to transaction processing and subscription management system 24 using path 44*i*, etc. Moreover, the paths used to receive certain video information may be different from those used to receive racing data. For example, user television equipment 22 may receive racing videos using path 44*f*, but may receive racing data using path 44*i*. These examples are merely illustrative. Any suitable combination of paths may be used to distribute racing data and other information for the interactive wagering service, any suitable combination of paths may be used to receive videos, and any suitable combination of paths may be used to send data to the wagering service.

If desired, the user may interact with the wagering service using more than one platform. For example, the user may place a wager using a cellular telephone while the user is driving home. When the user arrives home, the user may determine the outcome of the wager by watching a video of the race on user television equipment. Later in the day, the user may check the user's account balance using a personal computer. This is merely an illustrative example. The various wagering platforms may be used in any suitable combination.

Although system 10 has been described in the context of a system that supports multiple wagering platforms, system 10 may support fewer platforms if desired. For example, aspects of the invention may be implemented using a system 10 that only supports cellular telephone wagering or wagering using handheld computer devices. If desired, system 10 may be configured so that it does not support personal computer wagering, wagering with standard telephones, or wagering with user television equipment. The system may support cellular telephones and/or handheld computing devices such as personal digital assistants, palm-sized computers, etc. in combination with any other suitable platform.

The automatic horse selection features of the present invention are described herein primarily in the context of an interactive wagering application implemented on user computer equipment such as a personal computer. This is only illustrative. An interactive wagering application implemented on any suitable platform (user television equipment, user telephone equipment, etc.) may be used to provide such features if desired. In set-top box arrangements, on-screen options may be made larger than they appear in computer-based arrangements to accommodate the greater viewing distance from which televisions are typically operated. Options may be selected by highlighting them using remote control arrow keys and by pressing an appropriate key such as an OK or enter or select key. In cellular telephone arrangements and handheld computer arrangements, options and information may be displayed using smaller screens than are typically available on personal computer or set-top box arrangements. To accommodate the smaller screen size, options that might otherwise be presented on a single screen may be displayed using multiple screens or layered menus. Options may be selected by highlighting them using navigation keys and pressing an appropriate select button on the cellular telephone or handheld computing device or by using a pen-based interface or the like.

The interactive wagering application may be implemented using application software that runs primarily on user television equipment, user computer equipment, user telephone equipment, or another local platform, or using a remote server or other computer that is accessed from the local platform. Arrangements in which interactive wagering services are implemented using software on remote computers that is accessed on-demand from local platforms may be referred to as client-server arrangements. Such client-server arrangements may be used to allow client processes set-top boxes or other platforms to access server processes running on servers located at cable system headends or other television distribution facilities 18 (FIG. 1). Regardless of the type of system architecture or platform used, the software that supports the interactive wagering service features described herein may be referred to as an interactive wagering application.

In a set-top box environment, the system may allow the user to launch the application by pressing a menu option in an interactive television program guide or other set-top box application or menu. If desired, the application may be launched automatically whenever the user tunes to a particular channel (e.g., the television wagering channel). After the user has tuned to this channel, the system may display an interactive icon on the user's television screen that indicates that the interactive wagering application is available. If the user presses an "OK" remote control key, the system may launch the application.

In a computer-based system, the user may access the interactive wagering application by browsing to an Internet web site or a site on a private network.

Systems based on cellular telephones or the like may be launched by selecting an appropriate on-screen menu option presented on the display of the cellular telephone.

Figure 2:
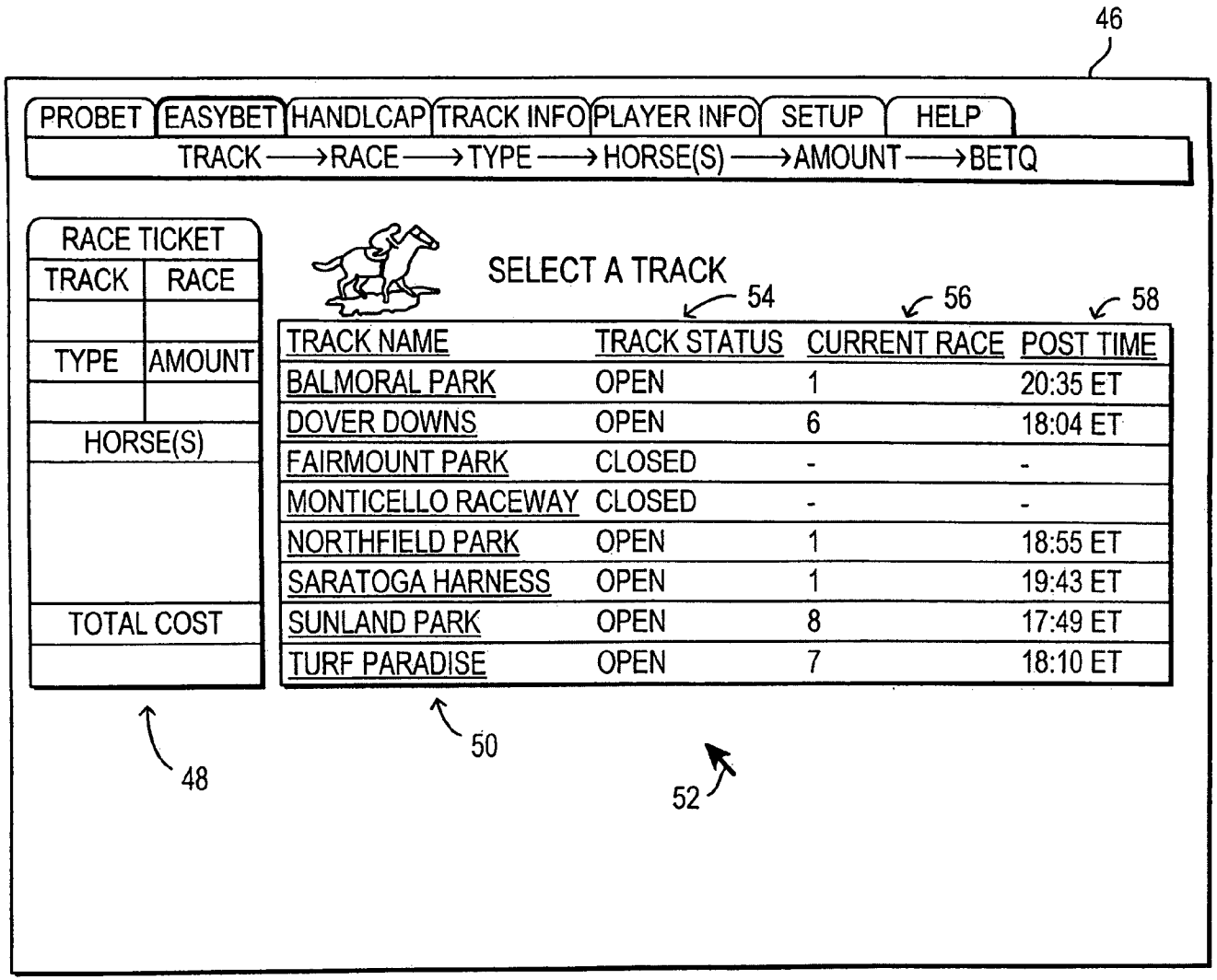
FIG. 2 shows an illustrative racetrack selection screen that may be provided by the interactive wagering application in accordance with the present invention.

An illustrative display screen 46 that may be provided by the interactive wagering application is shown in FIG. 2. Screen 46 and the screens shown in FIGS. 3-7 are examples of screens that may be displayed on a personal computer or other user computer equipment 20. The format and contents of such screens may be modified to accommodate different platforms such as user television equipment and user telephone equipment platforms if desired. Moreover, the information and options of the screens of FIGS. 2-7 may be provided using audio prompts to accommodate telephone-based wagering from touch-tone telephones without display screens.

As shown in FIG. 2, screen 46 may include a race ticket region 48 in which information about the wager that the user is currently building may be displayed. A list 50 of tracks may be provided from which the user may select a desired racetrack for which to place a wager. For example, the user may click on a track name of interest by using a mouse, trackball, or other pointing device to move pointer 52 on top of the desired name in list 50.

Track status information 54 may be provided for each track. For example, information may be provided on whether the track is open or closed.

If desired, information 56 may be provided that indicates the current race at each track. Post time information 58 may be provided for races that are still open.

Figure 3:
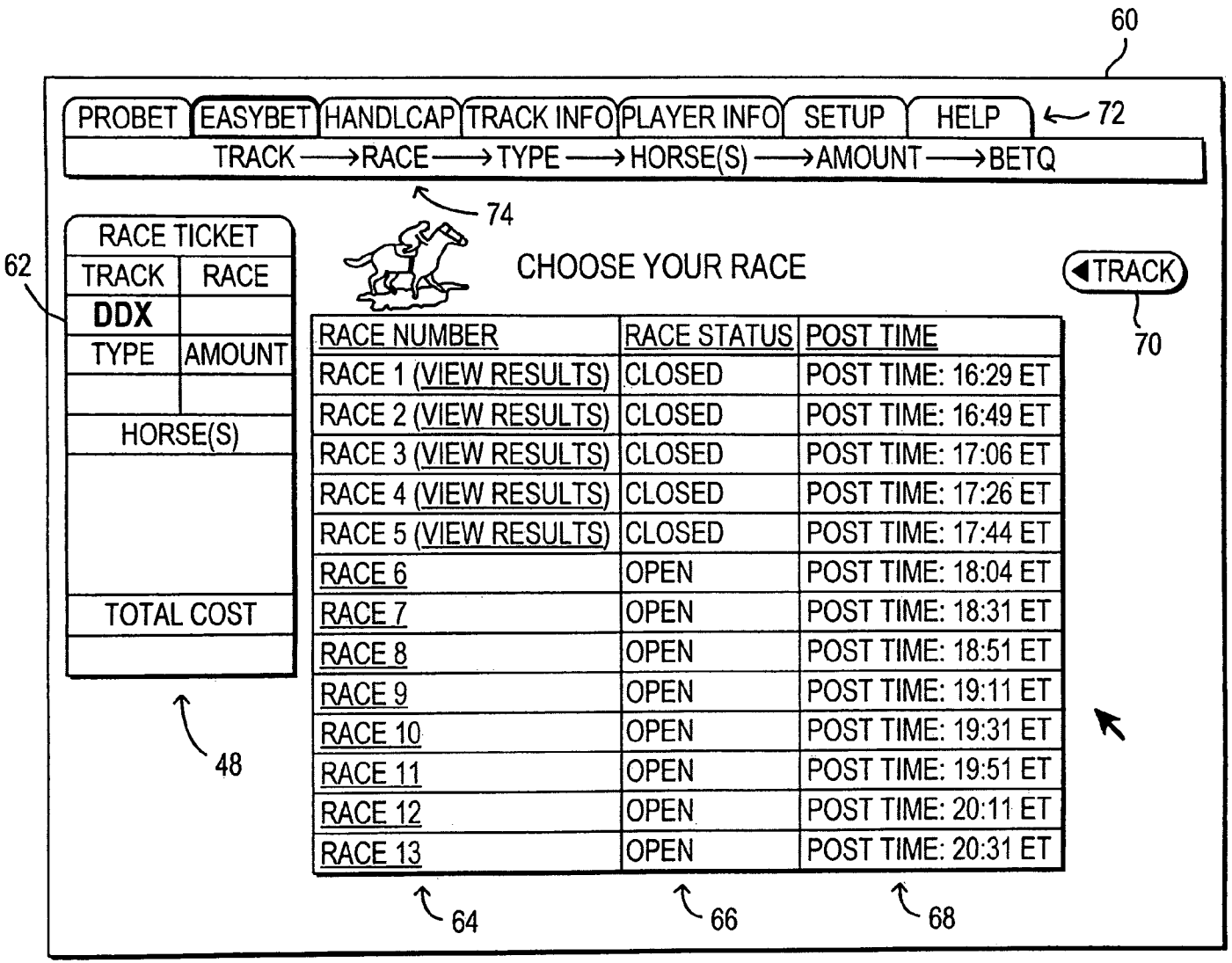
FIG. 3 shows an illustrative race-selection screen that may be provided by the interactive wagering application in accordance with the present invention.

After the user of the interactive wagering application selects a desired racetrack from screen 46, the application may display a race selection screen such as screen 60 of FIG. 3. As shown in FIG. 3, screen 60 may contain track information 62 in the race ticket region 48. Track information 62 shows the user which racetrack was selected using screen 46.

A list 64 of available races at the selected track may be displayed. The user may select a desired race from list 64 by clicking on the name for the race.

Race status information 66 my indicate which races are open and which races are closed.

Post time information 68 may indicate the post times for each race.

The user may return to track selection screen 46 of FIG. 2 to select a different track by selecting track option 70.

On screen 60 and the other screens of FIGS. 2-7, tabs 72 may be used to indicate the user's present location within the interactive wagering application. The user may select from proBet (a streamlined wagering interface for experienced users), easyBet (a more full-featured interface for novice users), Handicap (features that allow the user to obtain handicapping information), Track Info (information on various racetracks), Player Info (features that support wagering by multiple users), Setup (for setting up various settings of the interactive wagering application), and Help (context-sensitive help information).

A bar 74 or other suitable region may be displayed below tabs 72 (or in any other suitable location) that indicates the user's location within the wager creation process. The user's current location (e.g., the race selection menu of screen 60) may be indicated by coloring the appropriate word e.g., the word "race" in the example of FIG. 3).

Figure 4:
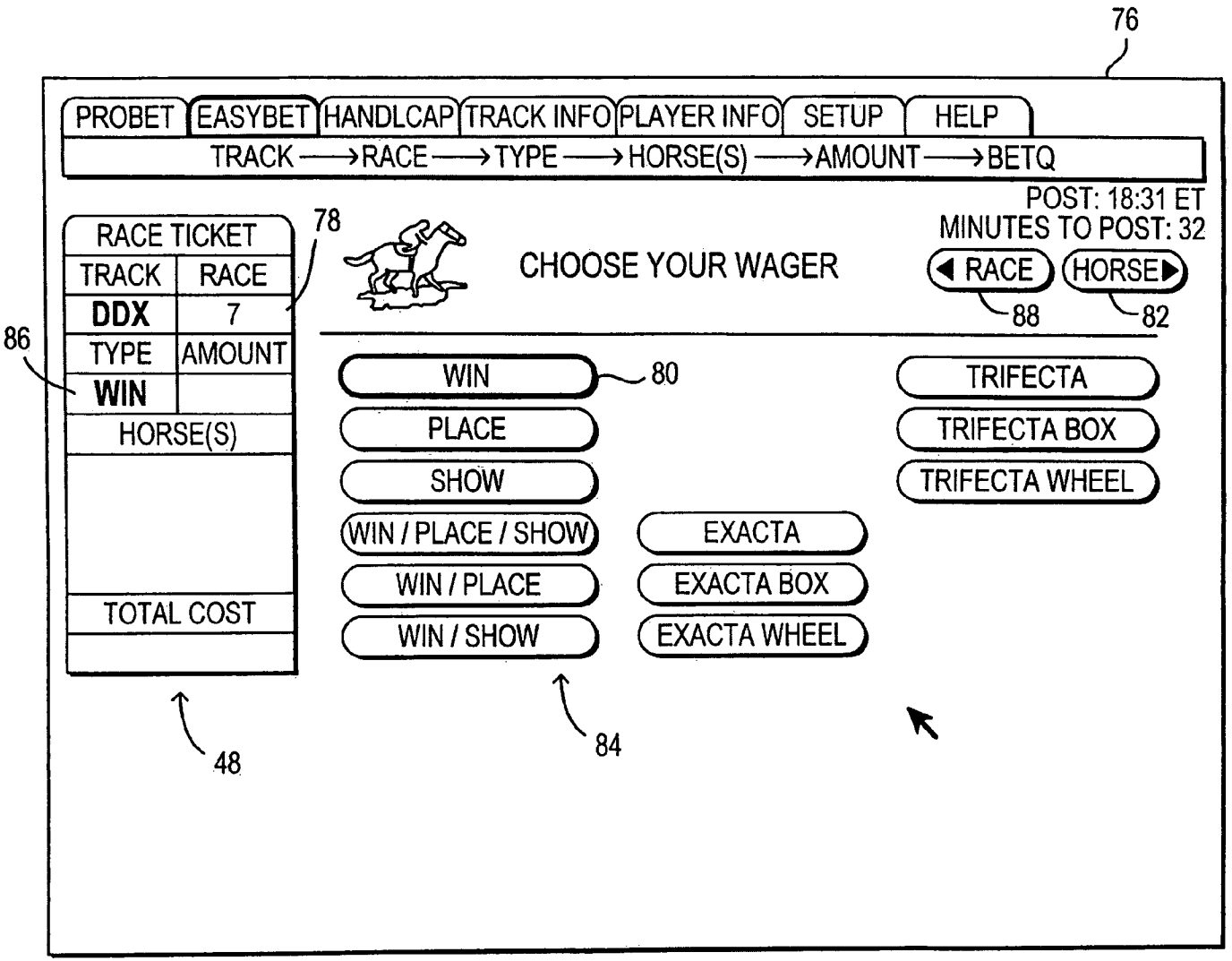
FIG. 4 shows an illustrative wager type selection screen that may be provided by the interactive wagering application in accordance with the present invention.

After the user has selected a desired race at the selected racetrack, the user may be presented with a screen such as screen 76 of FIG. 4. Screen 76 may allow the user to select a wager type for the wager. On screen 76, race ticket region 48 may be updated to include information 78 on which race was selected on screen 60. In the example of FIG. 4, the information 78 reflects that the selected race is race No. 7.

If desired, a default wager type may be highlighted on screen 76. In the example of FIG. 4, option 80 for a win wager has been highlighted. If the user wishes to place a win wager, the user may proceed to the horse selection menu by selecting horse option 82. If the user would like to place a different type of wager (e.g., a place wager, a show wager, etc.), the user may select one of the other wager type options 84 by clicking on that option. Information 86 may be provided in race ticket region 48 that indicates the highlighted wager type.

The user may return to race selection screen 60 by selecting option 88.

Figure 5:
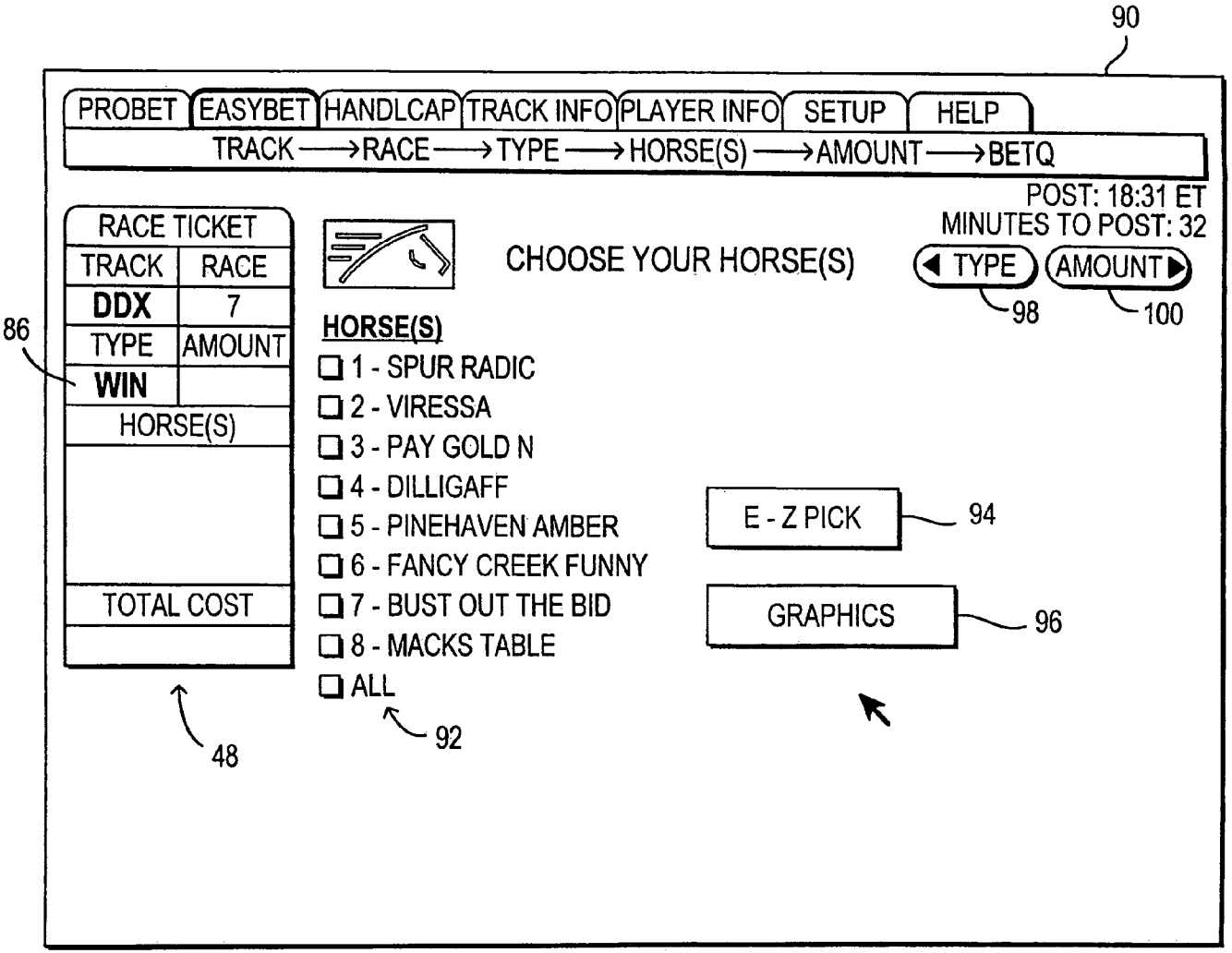
FIG. 5 shows an illustrative horse selection screen that may be provided by the interactive wagering application in accordance with the present invention.

After the has selected a desired wager type (e.g., a win wager in the example of FIG. 4), the interactive wagering application may present a horse selection screen to the user such as horse selection screen 90 of FIG. 5. Information 86 may be included in race ticket region 48 to indicate which wager type has been selected.

If desired, the user may select one or more horses for the wager by clicking on the appropriate horse options 92.

The interactive wagering application may provide an option such as E-Z pick option 94 that allows the user to direct the interactive wagering application to automatically pick the user's horses without intervention by the user. The option may be provided as a single clickable button such as option 94 or may be provided by multiple buttons. If desired, the option may be provided on a different screen than horse selection screen 90.

Regardless of how the automatic horse selection option is provided, the user may select the option when the user does not wish to manually select horses. When the user selects the automatic horse selection option, the interactive wagering application may automatically and randomly generate one or more horses to use for the user's wager. For example, if the user is placing a win wager, the interactive wagering application may pick a single horse for the win wager when the user selects option 94. If the user is placing an exacta wager, the interactive wagering application may automatically and randomly select two horses (a first place finisher and a second place finisher) for the exacta wager.

Because the user does not need to decide which particular horses to wager on, this feature may be attractive for novice users who are not familiar with the various horses who are running in a race. The feature may also be attractive to more experienced wagerers who occasionally would like to make a random selection (either as a stand-alone wager or as part of a group of wagers).

After the interactive wagering application has randomly selected a horse for the wager, the user may modify this selection by adding other horses or deselecting some or all of the randomly-selected horses.

If desired, a graphic image 96 may be provided to accompany the random selection of the horses. The graphic images may be related to the horses that are selected. For example, the graphic images may include the horse numbers that are selected. The graphic images may include animation. For example, an animated spinning wheel or the like may be provided that stops on the randomly-selected horse numbers. This is merely an illustrative example. Any suitable graphic images may be provided.

Moreover, other criteria for the wager may be selected randomly if desired. For example, the interactive wagering application may randomly select a racetrack, may randomly select a race, may randomly select a wager type, may randomly select a wager amount, etc. If desired, one, two, three, or any other suitable number of these multiple criteria may be randomly selected. For example, the interactive wagering application may provide an option that automatically randomly creates entire wagers for the user. When the user selects the option, a race ticket region may be provided in which all of the randomly-selected components of a complete wager are listed. The user may then decide whether or not to place the wager.

In the example of FIG. 5, the user may return to wager type selection screen 76 by selecting option 98. The user may advance towards completing the wager by selecting amount option 100.

Figure 6:
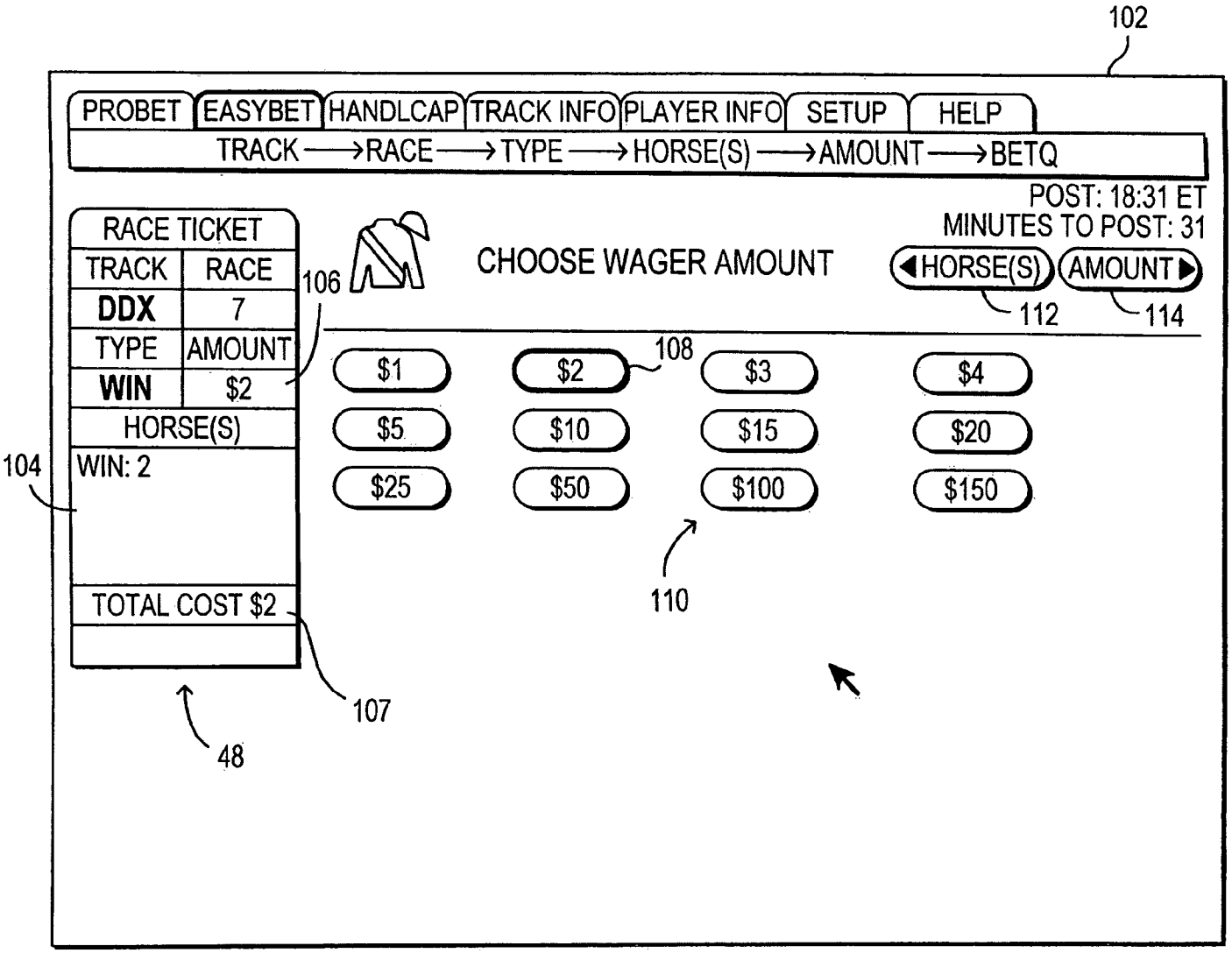
FIG. 6 shows an illustrative wager amount selection screen that may be provided by the interactive wagering application in accordance with the present invention.

If the user selects amount option 100 of FIG. 5, the user may be presented with a screen such as amount selection screen 102 of FIG. 6. In amount selection screen 102, race ticket region 48 may include information 104 on the selected horse or horses. In the example of FIG. 6, information 104 reflects that the interactive wagering application randomly selected horse number 2 for the user's win wager when the user selected E-Z pick option 94.

Race ticket region 48 in FIG. 6 also contains information 106 that reflects the default highlighted wager amount. Information 107 reflects the total cost of the wager, which may differ from the cost represented by information 106 when, for example, multiple horses have been selected for a wager that requires only one horse.

In the example of FIG. 6, $2 option 108 is highlighted by default and information 106 reflects this amount. The $2 amount is merely illustrative. Any suitable amount may be selected as a default. Moreover, no default amount need be selected. The user may be required to select a wager amount. If desired, the wager amount may be selected as a default only if some part of the wager is being generated randomly. Because this feature may be used by novices, it may be desirable for the default amount to be set at $2.

If the user desires to change the default amount to another amount (even if the horses or other aspects of the wager have been selected randomly), the user may select one of the other wager amount options 110.

Option 112 may be provided to allow the user to return to horse selection screen 90.

When the user is ready to place the wager, the user may select bet queue option 114.

Figure 7:
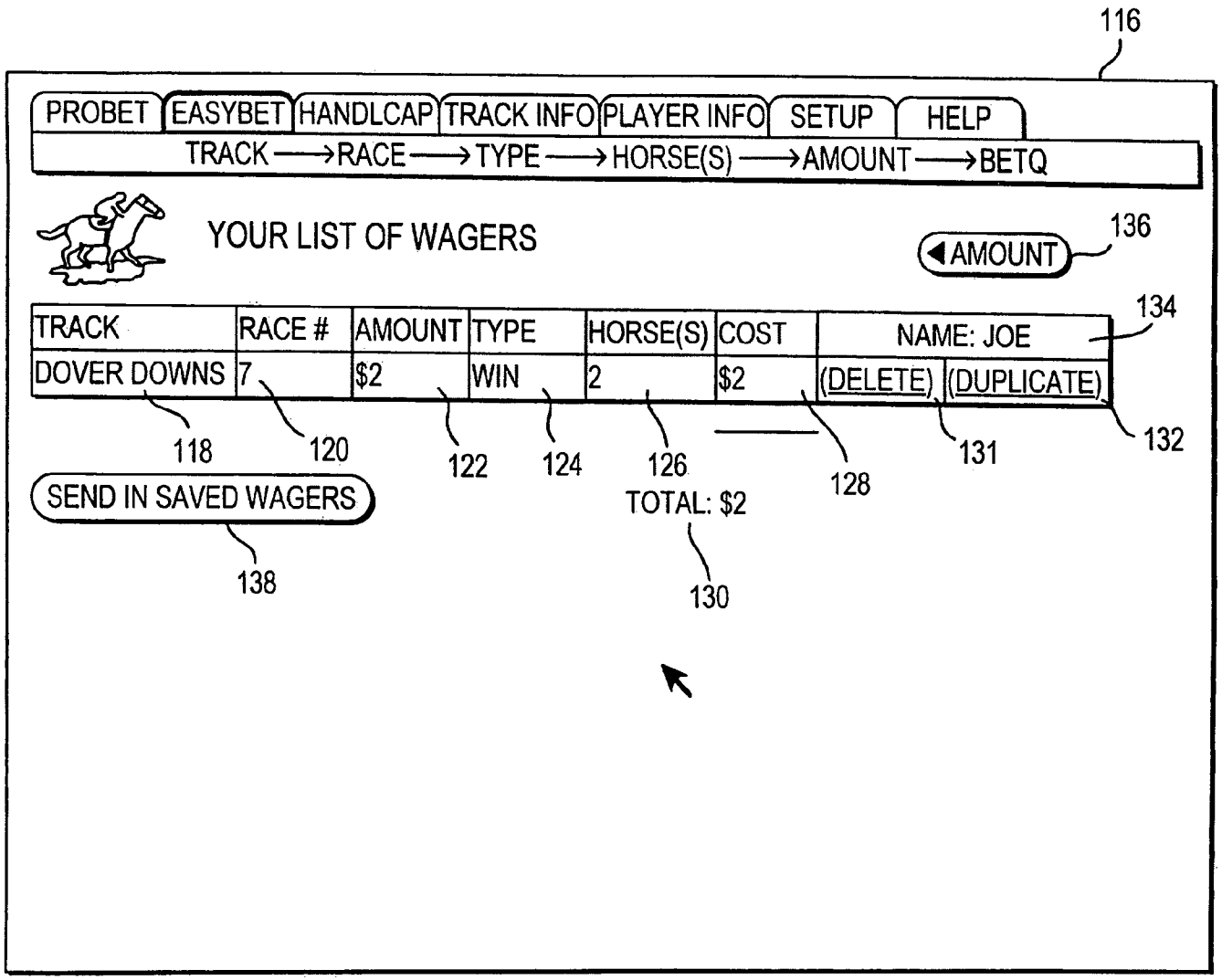
FIG. 7 shows an illustrative wager list screen that may be provided by the interactive wagering application in accordance with the present invention.

When the user selects bet queue option 114, the interactive wagering application may present a screen such as wager list screen 116 of FIG. 7. Screen 116 may contain information 118 on the selected track for the wager, information 120 on the selected race number for the wager, and information 122 on the selected wager amount for the wager. Information 124 may also be included on the selected wager type for the wager. Information 126 may be presented on which horses have been selected for the wager. If the race involves runners other than horses (e.g., dogs, etc.), the numbers for those runners may be presented instead of horse numbers.

Information 128 on the cost of each wager may be presented in a column. The total cost 130 of all of the wagers added together may also be presented.

Option 131 may be provided to allow the user to delete wagers from the list of screen 116. Duplicate option 132 may allow the user to duplicate a wager.

The interactive wagering application may support multiple users. For example, multiple users in a home may access the interactive wagering application through a common personal computer. Personal identification numbers (PINs) may be created for each user. When the user enters a PIN when signing into the system, the interactive wagering application may look up the user's name and may display the user's name in region 134.

Amount option 136 may be used to return wager amount screen 102 of FIG. 6.

When the user is satisfied with the wagers listed in screen 116, the user may select send in saved wagers option 138. This submits the wagers from the user's device (e.g., user computer equipment 20, etc.) to transaction processing and subscription management system 24 of FIG. 1. Transaction processing and subscription management system 24 may then process the wager and credit or debit the user's account according to the results of the race.

Figure 8:
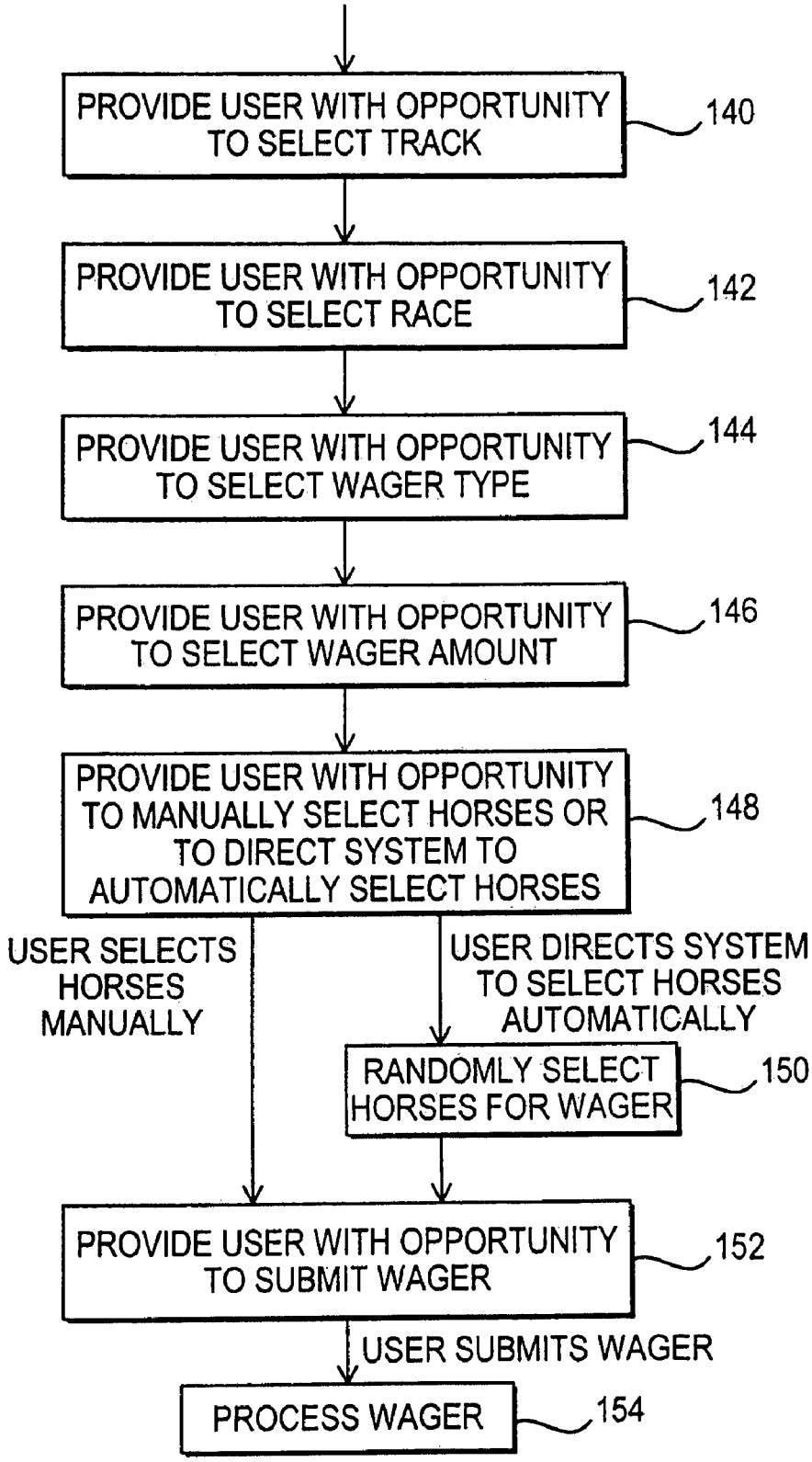
FIG. 8 is a flow chart of illustrative steps involved in using the interactive wagering application in accordance with the present invention.

Illustrative steps involved in allowing the user to use the interactive wagering application to wager with randomly-generated horse numbers are shown in FIG. 8. At step 140, the interactive wagering application may provide the user with an opportunity to select a track. For example, a user at user computer equipment 20 may be provided with a screen containing on-screen options that the user may select to choose a desired track. A user at user television equipment 22 or user telephone equipment 32 having a display may also be provided with an opportunity to select a desired track using on-screen options or the like. A user at user telephone equipment 32 without (or with) a display may be presented with audio prompts to which the user may respond by pressing appropriate touch-tone keys to select a desired track.

At step 142, the interactive wagering application may provide the user with an opportunity to select a race at the selected track. For example, a user at user computer equipment 20 may be provided with a screen containing on-screen options that the user may select to choose a desired race. A user at user television equipment 22 or user telephone equipment 32 having a display may also be provided with an opportunity to select a desired race using on-screen options or the like. A user at user telephone equipment 32 without (or with) a display may be presented with audio prompts to which the user may respond by pressing appropriate touch-tone keys to select a desired race.

At step 144, the interactive wagering application may provide the user with an opportunity to select a desired wager type. For example, a user at user computer equipment 20 may be provided with a screen containing on-screen options that the user may select to choose a desired wager type. A user at user television equipment 22 or user telephone equipment 32 having a display may also be provided with an opportunity to select a desired wager type using on-screen options or the like. A user at user telephone equipment 32 without (or with) a display may be presented with audio prompts to which the user may respond by pressing appropriate touch-tone keys to select a desired wager type.

The wager amount selection process may be performed before or after the horses for the wager are selected or at any other suitable time. For example, the wager amount selection process may take place just before the horses have been selected.

With this type of arrangement, the interactive wagering application may provide the user with an opportunity to select a desired wager amount at step 146. For example, a user at user computer equipment 20 may be provided with a screen containing on-screen options that the user may select to choose a desired wager amount. A user at user television equipment 22 or user telephone equipment 32 having a display may also be provided with an opportunity to select a desired wager amount using on-screen options or the like. A user at user telephone equipment 32 without (or with) a display may be presented with audio prompts to which the user may respond by pressing appropriate touch-tone keys to select a desired wager amount.

The interactive wagering application may provide the user with an opportunity to select desired horses for the wager at step 148. For example, a user at user computer equipment 20 may be provided with a screen containing on-screen options that the user may select to choose certain desired horses manually. The screen may also contain an option such as E-Z pick option 94 of FIG. 5 in addition to or instead of the manual horse selection options. A user at user television equipment 22 or user telephone equipment 32 having a display may also be provided with a screen containing on-screen options that the user may select to choose certain desired horses manually.

The screen provided with user television equipment 22 or user telephone equipment 32 may also contain an option such as E-Z pick option 94 of FIG. 5 in addition to or instead of the manual horse selection options. A user at user telephone equipment 32 without (or with) a display may be presented with audio prompts to which the user may respond by pressing appropriate touch-tone keys to select horses either manually or automatically (using the randomly-generated selections of the interactive wagering application).

If, at step 148, the user opts to have the interactive wagering application randomly select the horses for the user, the interactive wagering application may perform this function at step 150. Numbers may be randomly selected using a random number generation application at transaction processing and subscription management system 24 (e.g., on computer equipment 26), or on user television equipment 22, user computer equipment 20, or user telephone equipment 32, or at television distribution facilities 18, or any other suitable location or platform.

After the user selects the horses manually or the interactive wagering application selects the horses automatically, the user may be provided with an opportunity to submit the wager to transaction processing and subscription management system 24 at step 152. For example, a user at user computer equipment 20 may be provided with a screen containing an on-screen option that the user may select when the user desires to submit the wager. A user at user television equipment 22 or user telephone equipment 32 having a display may also be provided with an opportunity to submit a wager using an on-screen option or the like. A user at user telephone equipment 32 without (or with) a display may be presented with audio prompts to which the user may respond by pressing appropriate touch-tone keys to submit a desired wager.

After the user has submitted the wager at step 152, the wager may be processed by transaction processing and subscription management system 24 (FIG. 1) at step 154.

If desired, the randomly-generated horse number feature of the present invention may be used with other types of racing, such as dog or harness racing (a type of horse racing). An E-Z pick option may be provided for supporting these types of wagering. When the user selects the E-Z pick option, the interactive wagering application randomly picks the numbers of the appropriate runners (e.g., dogs or harness racers, etc.).

The foregoing is merely illustrative of the principles of this invention and various modifications can be made by those skilled in the art without departing from the scope and spirit of the invention.

What is claimed is:

1. A method for placing interactive wagers on races using an interactive wagering application implemented at least in part on electronic user equipment, the method comprising:

receiving, with the interactive wagering application, a user input to automatically select a race and at least one runner to be used in a wager;

accessing racing data comprising the available races and the available runners for those races;

in response to receiving the user input, randomly selecting a race from the available races and randomly selecting at least one runner from the available runners for the selected race; and placing the wager for the selected race and selected at least one runner using the interactive wagering application on said electronic user equipment.

2. The method defined in claim 1 further comprising using the interactive wagering application to randomly select a wager criterion, wherein the wager criterion is selected from the group consisting of a racetrack, a wager type, and a wager amount.

3. The method defined in claim 1 further comprising using the interactive wagering application to manually select a wager criterion, wherein the wager criterion is selected from the group consisting of a racetrack, a wager type, and a wager amount.

4. The method defined in claim 1 further comprising using the interactive wagering application to reselect a wager criterion at any point before placing the wager, wherein the wager criterion is selected from the group consisting of a racetrack, a race, at least one runner, a wager type, and a wager amount.

5. The method defined in claim 1, wherein randomly selecting the race and randomly selecting the at least one runner comprises using a random-number generator.

6. The method defined in claim 1 further comprising processing the wager with equipment remote from the user equipment after placing the wager.

7. The method defined in claim 1, wherein the wager is associated with a wager type, and wherein the interactive wagering application automatically selects the appropriate number of runners for the wager type.

8. The method defined in claim 1, wherein receiving a user input comprises receiving a single user input to automatically select all the wager criteria for a wager, wherein the wager criteria comprises a racetrack, a race, at least one runner, a wager type, and a wager amount, wherein each wager criterion is selected randomly.

9. The method defined in claim 1 further comprising displaying a screen on the user equipment that includes an onscreen option that allows the user to direct the interactive wagering application to automatically select the race and the at least one runner.

10. The method defined in claim 1, wherein the user equipment is selected from the group consisting of user television equipment, user computer equipment, user telephone equipment, cellular telephone equipment with a display, and handheld computer equipment.

11. An interactive wagering system for placing wagers on races using an interactive wagering application, comprising:

user equipment configured to:

receive, using the interactive wagering application, a user input to automatically select a race and at least one runner to be used in a wager;

access racing data comprising the available races and the available runners for those races;

randomly select, in response to receiving the user input, a race from the available races randomly select at least one runner from the available runners for the selected race; and place the wager for the selected race and selected at least one runner using the interactive wagering application.

12. The system defined in claim 11, wherein the user equipment is further configured to receive, using the interactive wagering application, a user input to randomly select a wager criterion, wherein the wager criterion is selected from the group consisting of a racetrack, a wager type, and a wager amount.

13. The system defined in claim 11, wherein the user equipment is further configured to receive, using the interactive wagering application, a user input to manually select a wager criterion, wherein the wager criterion is selected from the group consisting of a racetrack, a wager type, and a wager amount.

14. The system defined in claim 11, wherein the user equipment is further configured to receive, using the interactive wagering application, a user input to reselect a wager criterion at any point before placing the wager, wherein the wager criterion is selected from the group consisting of a racetrack, a race, at least one runner, a wager type, and a wager amount.

15. The system defined in claim 11, wherein the system further comprises a random-number generator, and wherein the user equipment is further configured to randomly select the race and randomly select the at least one runner using the random-number generator.

16. The system defined in claim 11, wherein the system further comprises equipment remote from the user equipment configured to process the wager after placing the wager.

17. The system defined in claim 11, wherein the wager is associated with a wager type, and wherein the interactive wagering application automatically selects the appropriate number of runners for the wager type.

18. The system defined in claim 11, wherein receiving a user input comprises receiving a single user input to automatically select all the wager criteria for a wager, wherein the wager criteria comprises a racetrack, a race, at least one runner, a wager type, and a wager amount, wherein each wager criterion is selected randomly.

19. The system defined in claim 11, wherein the user equipment is further configured to display a screen that includes an onscreen option that allows the user to direct the interactive wagering application to automatically select the race and the at least one runner.

20. The system defined in claim 11, wherein the user equipment is selected from the group consisting of user television equipment, user computer equipment, user telephone equipment, cellular telephone equipment with a display, and handheld computer equipment.

21. A computer-readable medium encoded with computer-readable instructions for use in placing interactive wagers on races using an interactive wagering application implemented at least in part on user equipment, the computer readable instructions comprising:

receiving, with the interactive wagering application, a user input to automatically select a race and at least one runner to be used in a wager;

accessing racing data comprising the available races and the available runners for those races;

in response to receiving the user input, randomly selecting a race from the available races and randomly selecting at least one runner from the available runners for the selected race; and placing the wager for the selected race and selected at least one runner using the interactive wagering application on said user equipment.

* * * * *